United States Patent [19]

Pitman et al.

[11] 4,354,921

[45] Oct. 19, 1982

[54] SOLVENT DEWAXING PROCESS

[75] Inventors: Herbert J. Pitman, Nederland; Charles W. Harrison, Houston, both of Tex.

[73] Assignee: Texaco Inc., White Plains, N.Y.

[21] Appl. No.: 286,946

[22] Filed: Jul. 27, 1981

[51] Int. Cl.[3] ..... C10G 73/06; C10G 73/32

[52] U.S. Cl. ..... 208/33

[58] Field of Search ..... 208/33; 23/301 R

[56] References Cited

U.S. PATENT DOCUMENTS

| | | | |
|---|---|---|---|
| 2,887,723 | 2/1956 | Hallie et al. | 23/301 R |
| 3,038,854 | 6/1962 | Kiersted, Jr. | 208/33 |
| 3,448,588 | 7/1966 | Scoggin | 23/301 R |
| 3,764,517 | 10/1973 | Bodemuller, Jr. | 208/33 |
| 3,775,288 | 11/1973 | Eagen et al. | 208/33 |
| 4,115,241 | 9/1978 | Harrison et al. | 208/33 |

*Primary Examiner*—Delbert E. Gantz

*Attorney, Agent, or Firm*—Carl G. Ries; Robert A. Kulason; Robert Knox, Jr.

[57] ABSTRACT

An improved method for solvent dewaxing oils in which a portion of the oil-solvent mixture is chilled to a temperature above its cloud point and a further portion is chilled to a temperature below its cloud point, the portions are combined to produce a mixture substantially at the cloud point, and the combined mixture further cooled to dewaxing temperature at which wax crystals are separated from the solvent and refined oil.

10 Claims, 1 Drawing Figure

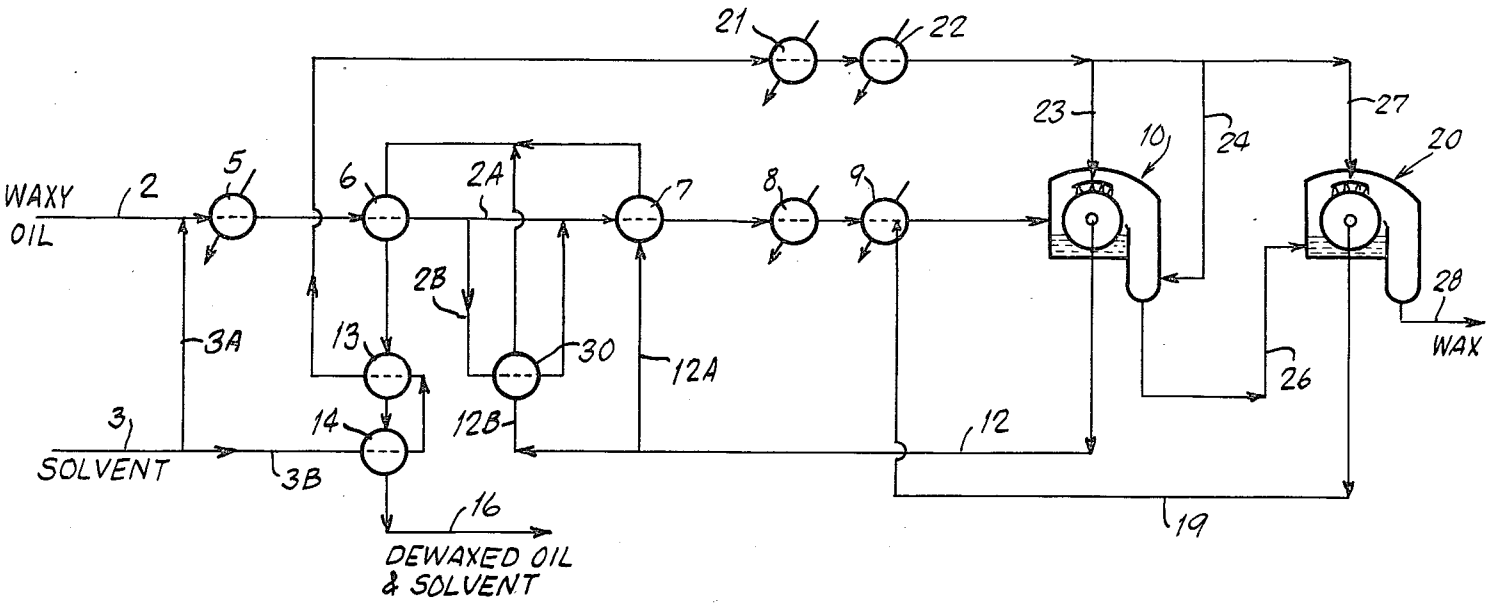
WAXY OIL
SOLVENT
DEWAXED OIL & SOLVENT
WAX
2
3
3A
3B
5
6
7
8
9
10
12
12A
12B
13
14
16
19
20
21
22
23
24
26
27
28
30

SOLVENT DEWAXING PROCESS

This invention relates to a process for solvent dewaxing of waxy petroleum oils. In one of its more specific aspects, the process of this invention comprises diluting a lubricating oil base stock with solvent to form a homogeneous mixture, cooling the mixture to a temperature just above its cloud point, separating the precooled mixture into two portions, e.g., a main stream or major portion of the lubricating oil feedstock and a side stream or minor portion of the lubricating oil base stock, cooling the minor portion to a temperature below its cloud point, blending the subcooled minor portion with the precooled major portion, further cooling the recombined mixture and separating wax from a dewaxed oil-solvent mixture. The present process results in the formation of wax crystals which have improved filter rates as compared with conventional slow cooling and incremental solvent dilution methods.

Processes involving conventional chilling and incremental dilution methods of solvent dewaxing of waxy petroluem lubricating oil base stocks are well known in the art. In general, a suitable solvent is added to a waxy oil base stock and the mixture cooled at a controlled rate in a scraped surface heat exchanger to a temperature at which solid wax crystals form in the mixture. As the temperature is progressively lowered, the amount of wax precipitated from the oil-solvent mixture increases until the desired dewaxing temperature is reached. The wax may be then separated from the oil-solvent mixture by filtration and solvent recovered from the dewaxed oil for reuse in the process. Such prior art processes are illustrated in U.S. Pat. Nos. 3,764,517; 4,115,243; and 4,140,620, incorporated herein by reference.

In most of the industrial processes for the separation of wax from petroleum oil stocks, dewaxing solvent is mixed with a waxy oil stock incrementally, i.e., a portion of the solvent is mixed with the oil before chilling and additional chilled solvent is added to the oil base stock at several points during the chilling process. The waxy oil and solvent may be chilled at a rate in the range of 0.5° to 2.5° C. per minute. Generally, the waxy oil feedstock is prediluted with solvent at a temperature sufficient to effect complete miscibility of the oil and solvent prior to chilling. The oil and an initial amount of solvent may be mixed with one another at a temperature above that at which wax crystals begin to form, i.e., above the cloud point of the oil feedstock, or the oil may be diluted with solvent and the oil-solvent mixture heated to a temperature above the cloud point to ensure complete solution of oil and wax in solvent.

In some processes, solvent is added to the oil at a temperature below the temperature of the oil to effect simultaneous chilling and dilution of the oil and oil-solvent mixtures in the system. U.S. Pat. No. 3,775,288 and related patents describe dewaxing processes in which cooling and dilution of the lubricating oil stocks is accomplished simultaneously by the incremental addition of cold solvent to the oil stock with intense agitation at each point of solvent injection. Simultaneous chilling and agitation of a lubricating oil stock during cooling is known in the art as dilution chilling.

Solvents known to be useful as dewaxing solvents are the ketones containing three to six carbon atoms, for example, acetone, methylethylketone (MEK) and methylisobutylketone (MIBK); mixtures of ketones; and mixtures of ketones with aromatic hydrocarbons including benzene and toluene. Halogenated low molecular weight hydrocarbons, including dichloromethane and dichloroethane, and their mixtures are also known dewaxing solvents.

In a typical commercial process, the waxy oil charge is diluted with solvent and heated, if necessary, to a temperature at which all the wax present in the charge is dissolved. The homogeneous charge is then passed to a cooling zone wherein cooling takes place at a uniformly slow rate in the range of about 0.5° to 5° C. per minute until the desired dewaxing temperature is reached. When the dewaxing temperature is reached, usually in the range of −18° to −26° C., the mixture is filtered for separation of solidified wax, and a dewaxed lubricating oil base stock of the desired pour point, generally in the range of about −9° to −18° C., is obtained. Wax crystals are separated from the mixture of oil and solvent at the dewaxing temperature as a solid wax containing a minor proportion of oil (slack wax). The separated oil-solvent solution is further processed for recovery of solvent and product dewaxed oil. The slack wax may be subjected to additional processing for recovery of occluded oil and production of a product wax.

The recovery of solvent from dewaxed oil and from wax-solvent mixtures produced in solvent dewaxing operations may be effected by distillation. A combination of high and low pressure flash vaporization stages followed by stripping with steam or inert gas is generally preferred. A system for recovering solvents from a dewaxed oil-solvent solution and from a wax slurry by a combination of high and low pressure flash vaporization followed by gas stripping is disclosed in U.S. Pat. No. 4,052,294, incorporated herein by reference.

In commercial solvent dewaxing processes, separation of crystalline wax from dewaxed oil-solvent solutions is commonly accomplished in rotary drum vacuum filters. Rotary drum vacuum filters are common articles of commerce, and are well understood by those skilled in the art. Wax separated from the dewaxed oil-solvent mixture by filtration is referred to as slack wax, and the filtration step is referred to as primary filtration. Slack wax from a primary filter contains a quantity of dewaxed oil entrained and occluded in the wax crystals. In order to improve the recovery of dewaxed oil and at the same time improve the quality of the recovered wax, slack wax from the primary filter is often slurried with additional cold dewaxing solvent to dissolve the dewaxed oil contained in the wax. This slurry is filtered in a second filtration step to yield a wax cake of substantially reduced oil content and a solvent solution of dewaxed oil by means of a rotary filter termed a repulp filter. A third stage, called wax deoiling, is sometimes used. In this case, a second wax-solvent slurry is subjected to a third filtration conducted at a somewhat higher temperature than the second filtration to remove essentially all the remaining oil as well as low melting point wax components from a relatively hard product wax. In the process of the present invention, the initial oil-solvent mixture, which is at a temperature above its cloud point, is divided into two streams, namely, a main stream comprising the major portion of the oil-solvent mixture and a sidestream comprising a minor portion of the oil-solvent mixture. The sidestream or minor portion is cooled, with or without agitation, to a temperature below its cloud point and sufficiently below the temperature of the main stream or major portion of the oil-solvent mixture that, when mixed, the temperature of the composite mixture is near its cloud point. The temperatures and relative proportions of the two streams may vary, but preferably are such that, when mixed, the temperature of the mixture is at or below its cloud point. The chilled sidestream or minor portion of the oil-solvent mixture containing small wax crystals is added to the precooled main stream or major portion of the oil-solvent mixture resulting in cooling of the main stream or major portion of the oil-solvent mixture to a temperature substantially at or below the cloud point of the mixture. The combined mixture is then further cooled at a predetermined rate, preferably with incremental solvent addition and minimum agitation, to dewaxing temperature.

It has been found that addition of an oil-solvent mixture containing minute wax crystals produced by cooling the oil-solvent mixture from a temperature above its cloud point to a temperature below its cloud point to a second portion of the same oil-solvent mixture under conditions resulting in chilling the composite mixture to a temperature substantially at or below its cloud point, followed by conventional cooling, results in substantially improved filtration rates as compared with conventional cooling of the entire stream of charge oil with solvent additions to the same dewaxing temperature.

In accordance with one embodiment of the method of the present invention, waxy petroleum oil, optionally diluted with solvent, is precooled to a temperature above its cloud point, a minor portion of the precooled oil or oil-solvent mixture is subcooled to a temperature below its cloud point, and then mixed with the remainder of the oil or oil-solvent mixture to reduce the temperature of all of the oil or oil-solvent mixture to a temperature below its cloud point. The chilled composite mixture is further cooled, optionally with further solvent additions to the final or filtration temperature. Typically, the cooling rate is within the range of 0.5° C. to 3° C. per minute. The step of mixing the subcooled minor portion of the oil containing wax crystals with the major portion of the oil to chill the major portion of the oil to a temperature below the cloud point of the resulting composite mixture may be carried out with or without agitation and is the most significant step in the process. After mixing, the recombined or the composite mixture is further cooled, preferably with incremental addition of solvent and with minimum stirring or agitation, until the final or filtration temperature is reached.

The process of this invention is generally applicable to various solvent dewaxing systems, such as propane dewaxing, or well known solvent dewaxing operations employing as dewaxing solvent a mixture of a mineral oil solvent, including aromatic hydrocarbons, e.g. benzene, toluene, and the like, and a wax anti-solvent, particularly a normal liquid aliphatic ketone containing from three to nine carbon atoms per molecule, e.g. acetone, methylethylketone, methylisobutylketone, methyl-n-propylketone, and the like. Usually, the preferred aliphatic ketone is methylethylketone or methylisobutylketone and the preferred aromatic hydrocarbon is benzene or toluene. The process is applicable to other solvent systems, e.g. dichloromethane, dichloroethane, and mixtures of halogenated hydrocarbons, e.g. a mixture of dichloroethylene and methylene chloride. Such solvent systems are well known in the art.

In a preferred embodiment of the process of this invention, the feed material undergoing dewaxing is prediluted with an equal volume of solvent, precooled to a temperature above the cloud point of the oil-solvent mixture, separated into two portions or streams, i.e., a main stream or major portion comprising about one half to nine tenths of the oil-solvent mixture, suitably about 60 to 80 percent, and a sidestream or minor portion, comprising about one tenth to one half, suitably about 20 to 40 percent of the oil-solvent mixture; the minor portion or sidestream is cooled to a temperature below its cloud point; the two portions or streams mixed with one another and the temperature of the mixture reduced to a temperature below its cloud point.

By "cloud point" is meant that temperature at which crystals or precipitated solid material first begin to appear in oil or an oil-solvent mixture as indicated by observation of a visible haze therein. The cloud point is usually determined in a laboratory under standard ASTM test conditions. It will be understood that the cloud point of a mixture of oil and solvent, in the case where the oil base stock is prediluted with a portion of the dewaxing solvent, will be lower than the cloud point for the undiluted base stock. This lowered cloud point is sometimes referred to as the depressed cloud point of the oil. The cloud point for any particular dilution or mixture of solvent and petroleum base stock may be determined in a laboratory and these results translated to plant operations.

Predilution of the base stock with solvent is generally desirable, and usually is essential when high viscosity base stocks are treated. Conventionally, sufficient solvent is added to a base stock prior to or during its initial chilling to maintain allowable viscosities and associated pressure drops within the heat exchange equipment. Predilution of oil with an equal volume of solvent is generally preferred. Although all of the solvent may be added to the oil initially, the major portion of the solvent is generally added to the system after the initial wax crystals have formed, i.e. after the temperature of the oil base stock with or without dilution has reached a temperature somewhat below the cloud point of the waxy petroleum fraction. The total dilution of oil with solvent exclusive of wash solvent, is preferably in the range of 1.8 to 4 volumes of solvent per volume of oil. The volume of wash solvent may range from 0 to 2 volumes, preferably 0.5 to 1 volume of wash solvent per volume of charge oil.

Following mixing or recombination of the major and minor portions of the cooled solvent-oil mixtures, the resulting chilled mixture of waxy petroleum oil containing wax crystals is gradually cooled substantially without agitation, e.g. by cooling in scraped wall double pipe heat exchangers in conventional manner. The initial cooling of the minor portion or side stream from solution temperature, e.g. 50° C. to 65° C., to a temperature of the order of 5° to 30° C. preferably 10° to 20° C. below its cloud point, is preferably carried out at a rate of the order of 0.5 to 2.5° C. per minute. After the two portions are mixed, the mixture of oil and solvent containing wax crystals is cooled under substantially nonturbulent flow conditions at a normal cooling rate, e.g. at a cooling rate in the range of 0.5° to 5° C. per minute, preferably 0.5° to 3° C. per minute, to the final dewaxing temperature, e.g. a temperature in the range of −5° to −40° C. The resulting mixture of dewaxed oil, solvent, and wax crystals is subjected to filtration, preferably by means of a rotary drum type vacuum filter wherein a mixture of dewaxed oil and solvent is drawn through the filter and the solid wax is retained on the filter as a wax cake. The wax cake is subsequently washed and removed from the filter in a continuous manner well known in the art.

Details of the invention will be evident from the accompanying FIGURE and the following detailed description of a preferred embodiment of the process of this invention.

The FIGURE is a diagrammatic representation of a preferred embodiment of the process of this invention.

With reference to the FIGURE, a waxy petroleum distillate supplied through line 2 is prediluted with solvent from line 3 via line 3A at a temperature effective for complete solution of the oil in solvent. Solvent introduced through line 3 is supplied from a suitable source as described hereinafter. In commercial operations, predilution of solvent and oil is usually carried out at a temperature in the range of 60° C. to 70° C. The mixture is then cooled in heat exchanger 5 where it is cooled by indirect heat exchange with cooling water and then passed through heat exchangers and chillers 6, 7, 8, and 9 where it is cooled to the desired dewaxing temperature and delivered to primary filter 10.

The chillers may comprise a plurality of scraped wall double pipe heat exchangers of the type well known in the art. Suitably, chillers 6, 7, 8, and 9 consist of double wall heat exchangers well known in the art which comprise an inner pipe through which the solvent-oil mixture is passed surrounded by an outer pipe or jacket of larger diameter supplied with a suitable coolant or heat exchange fluid. Coolant, comprising a dewaxed oil and solvent mixture obtained as a cold filtrate from a rotary drum vacuum filter 10, described later, is supplied to the annulus or jacket of chiller 7 through lines 12 and 12A and thereafter to the jacket of chiller 6 warming the filtrate and cooling the incoming mixture of oil and solvent. The resulting warmed filtrate then flows in sequence through heat exchangers 13 and 14 where it is further warmed by heat exchange with solvent from line 3 and discharged through line 16 to a solvent recovery system, not illustrated.

The incoming mixture of oil feedstock and solvent is progressively cooled during its passage through heat exchanger-chillers 5, 6, 7, 8 and 9 to the desired dewaxing temperature which may be in the range of −7° C. to −40° C. The resulting chilled mixture comprising solvent, dewaxed oil, and wax crystals is fed to primary filter 10. Additional solvent is added to the oil and solvent mixture through 19, suitably as cold filtrate containing small amounts of low melting point wax and oil from repulp filter 20, described hereinafter. Dilution of waxy petroleum oil stocks, especially lubricating oil base stocks, during the period of chilling and wax crystallization is a technique well known in the art. The cooling rate in the system of chillers 6, 7, 8 and 9 is not greater than about 6° C. per minute, usually within the range of 0.5° C. to 4.5° C. per minute, and preferably within the range of 1° C. to 3° C. per minute. Chillers 8 and 9 are cooled by a suitable refrigerant, e.g. ammonia, from a source not illustrated in the FIGURE.

In accordance with the present invention, the oil-solvent mixture undergoing chilling is cooled in heat exchanger-chiller 6 to a temperature just above the cloud point of the oil-solvent mixture, suitably to a temperature in the range of 3° C. to 6° C. above the cloud point of the mixture. The prechilled mixture is then divided into two streams or portions, i.e., a main-stream or major portion which is passed via line 2A directly from heat exchanger-chiller 6 to heat exchanger-chiller 7 and a sidestream or minor portion which is passed via line 2B through heat exchanger-chiller 30 where it is subcooled to a temperature below its cloud point, suitable in the range of 15° C. to 30° C. below its cloud point by indirect heat exchange with filtrate from filter 10 supplied to chiller 30 from line 12 via line 12B. Preferably the rate of cooling of the oil-solvent mixture in chiller 30 is within the range of 1° to 3° C. per minute.

Chillers 7, 8, 9 and 30 suitably comprise scraped wall heat exchangers and, although shown diagrammatically in the FIGURE, may each represent groups of heat exchangers, preferably of the double pipe type, and typically comprising some 20 to 24 double pipe heat exchangers arranged in four parallel banks and equipped with mechanical scrapers to remove paraffin accumulations from the inner wall of the inner pipe through which the mixture of oil and solvent is passed.

The subcooled minor portion or sidestream is blended with the major portion or mainstream ahead of chiller 7. The resulting recombined mixture of solvent, dewaxed oil, and wax crystals is further cooled in chillers 7, 8, and 9 and supplied at the desired dewaxing temperature to primary filter 10. Filter 10 is preferably a rotary drum type vacuum filter wherein the mixture of dewaxed oil and solvent is drawn through the filter and solid wax is retained on the filter surface. Filtrate, comprising a mixture of dewaxed oil and solvent, is withdrawn from the primary filter 10 through line 12 to the outer pipe or jacket of chillers 7 and 22, and then through chillers 6, 13 and 14 as already described.

Fresh solvent from line 3B is cooled in heat exchangers 13 and 14 by indirect heat exchange with filtrate from primary filter 10 thereby heating the filtrate and cooling the solvent. From heat exchanger 13, the solvent is passed through chillers 21 and 22 where it is cooled to the desired filtration temperature by heat exchange with suitable refrigerant, e.g. ammonia, supplied to the heat exchangers from sources not illustrated in the drawing. The chilled solvent from line 3B is employed as wash liquid and wax repulping medium as described hereinafter.

Wax cake accumulated on the surface of the filter drum of filter 10 is washed with cold solvent from line 23, removed from the primary filter in a continuous manner, mixed with additional cold solvent supplied by line 24 to form a slurry, and passed through line 26 to repulping filter 20. Oil retained in the wax cake discharged from the primary filter 10 is recovered in the repulping filter 20. The repulping filter 20 operates in a manner analogous to that of the primary filter 10 at essentially the same temperature as that of the primary filter 10 or at a slightly higher temperature, e.g. 2° C. to 5° C. higher than the temperature of primary filter 10. Repulp filtrate is withdrawn from repulping filter 20 through line 19. The repulp filtrate is added to the lubricating oil-solvent mixture in chiller 9 for dilution of the lubricating oil feedstock.

Wax cake accumulating on the filter in repulping filter 20 is washed on the filter with chilled clean solvent from line 27, removed from the filter in a continuous manner and discharged through line 28 as a wax product of the process. Solvent supplied to filters 10 and 20 through lines 23, 24, and 27 is precooled to dewaxing temperature.

The dewaxed oil mixture, comprising typically about 30 weight percent dewaxed hydrocarbon oil in admixture with solvent is passed through line 12, split into two streams, 12A and 12B, passing through heat exchanger-chillers 7 and 30, respectively, recombined, and then passed sequentially through heat exchanger-chillers 6, 13 and 14. The mixture of dewaxed oil and solvent is discharged through line 16 to solvent recovery facilities not illustrated in the drawing.

The following example illustrates the advantages of the process of the present invention as compared with conventional dewaxing processes in which the entire stream of oil and solvent is progressively cooled to dewaxing temperature.

EXAMPLES

A waxy distillate (RWD-50) suitable for the production of SAE 50 lubricating oil is mixed with solvent comprising 60 volume percent methylethylketone and 40 volume percent toluene in a ratio of 3.5 volumes of solvent for each volume of oil. The oil and solvent solution is made up at 66° C. ensuring complete solution of oil in solvent. The cloud point of this mixture is determined to be 45° C. One fifth of the prediluted mixture of oil and solvent is cooled to 32° C. thus crystallizing some of the higher melting wax. The remaining four fifths is cooled to 50° C. and the two portions mixed to form a composite wax-oil-solvent mixture at a temperature of 46° C. The composite mixture is cooled to −12° C. and filtered.

For comparison, a mixture of Wax Distillate-50 (RWD-50) and solvent is made up in the same proportions as above (3.5 volumes of a 60 MEK-40 toluene solvent per volume of feedstock) and the mixture chilled at a rate of 0.8° C. per minute to filtration temperature of −12° C. and filtered.

Properties of the Wax Distillate-50 feedstock are shown in Table I.

TABLE I

| | |
|---|---|
| Gravity, °API | 28.1 |
| Color, ASTM | 3.0 |
| Flash Point, F. | 540 |
| Viscosity, SUS @ 100 F. (38 C.) | 878 |
| 210 F. (99 C.) | 83.5 |
| Viscosity Index | 98 |
| Refractive Index @ 70 C. | 1.4710 |
| Pour Point, C. | 49+ |
| Carbon Residue | 0.21 |
| Sulfur, wt % | 0.74 |
| Basic Nitrogen, ppm | 216 |
| Ash, wt % | 0.001 |
| Neut. No. (St 47A) | 0.05 |

Results of these test runs are shown in Table I in which Run A and Run B represent standard conditions wherein the entire mixture of oil and solvent is slowly cooled to dewaxing temperature, and Run C and Run D represent the procedure of this invention in which portions of the oil-solvent mixture are first separately cooled and then combined as described above. In Runs A and C, the wax filter cake was not washed. In Runs B and D, the wax filter cake was washed with approximately two volumes of solvent per volume of charge stock.

TABLE II

COMPARISON WITH STANDARD SINGLE DILUTION METHOD

| Procedure | Standard | | This Process | |
|---|---|---|---|---|
| Run | A | B | C | D |
| Wash Ratio, Vol/Vol | 0 | 2.16 | 0 | 2.08 |
| Wax Cake Thickness, Cm | 0.6 | 0.6 | 0.6 | 0.6 |

TABLE II-continued

COMPARISON WITH STANDARD SINGLE DILUTION METHOD

| Procedure | Standard | | This Process | |
|---|---|---|---|---|
| Run | A | B | C | D |
| Dewaxed Oil Cycle Rate LPH/M$^2$ | 199.6 | 58.7 | 953.4 | 395.2 |
| Yield, Vol DWO/Vol Charge | 55.7 | 82.6 | 55.8 | 74.3 |
| Cycle Time, Min | 1.00 | 5.00 | 0.16 | 0.48 |
| Oil Content of Wax, Wt % | 24.2 | — | 25.0 | 21.2 |

It will be evident from the foregoing example that the filter rates, expressed in liters per hour of dewaxed oil (DWO) per square meter of filter area, are much higher by the process of this invention than by the standard procedure. Runs C and D, carried out in accordance with the procedure of this invention, produced filter rates (dewaxed oil cycle rates) 4.8 and 6.7 times as high as the standard procedure at wash ratios of 0 and 2, respectively.

We claim:

1. In a process for dewaxing a waxy lubricating oil stock by cooling said oil stock in the presence of a dewaxing solvent to a temperature effective for removal of wax therefrom by filtration wherein said oil stock is diluted prior to cooling with a portion of said dewaxing solvent to form a prediluted oil stock, the improvement which comprises cooling a major portion of said prediluted oil stock to a temperature above its cloud point, cooling a minor portion of said prediluted oil stock to a temperature below its cloud point thereby forming wax crystals dispersed in an oil-solvent mixture, combining said minor portion with said major portion to form a wax-oil-solvent composite mixture at a temperature substantially at the cloud point of said mixture, further cooling said mixture to dewaxing temperature, separating solid wax particles from resulting dewaxed oil and solvent, and recovering oil of diminished wax content therefrom.

2. The process of claim 1 wherein said major portion is cooled to a temperature in the range of 3° C. to 6° C. above its cloud point and said minor portion is cooled to a temperature within the range of 5° C. to 30° C. below its cloud point.

3. The process of claim 1 wherein the temperature of the composite mixture prior to further cooling is in the range of 5° C. above to 5° C. below its cloud point.

4. The process of claim 1 wherein said major portion comprises from one half to nine tenths of said oil stock.

5. The process of claim 1 wherein said composite mixture is further cooled to dewaxing temperature at a rate in the range of 0.5° C. to 3.5° C. per minute.

6. The process of claim 1 wherein said lubricating oil stock is diluted with 0.1 to 4 volumes of solvent per volume of oil prior to said initial cooling.

7. The process of claim 6 wherein additional solvent is added to said composite mixture in increments during cooling to a final solvent to oil dilution in the range of 1.8 to 4.

8. The process of claim 1 wherein said initial cooling of said minor portion is at a rate in the range of 0.5° to 3.5° C. per minute.

9. The process of claim 1 wherein said solvent comprises a mixture selected from the group (a) a dialkylketone and benzene or toluene, (b) acetone and toluene, (c) methylethylketone and methylisobutylketone, (d) methylethylketone and toluene, (e) propylene and acetone, (f) acetone, benzene and/or toluene, and (g) dichloroethane and dichloromethane.

10. The process of claim 1 wherein said solvent comprises a mixture of methylethylketone and toluene.

* * * * *